US005362105A

United States Patent [19]

Scott

[11] Patent Number: 5,362,105

[45] Date of Patent: Nov. 8, 1994

[54] SCANNER

[76] Inventor: Arthur C. Scott, 427 Elm St., Deerfield, Ill. 60015

[21] Appl. No.: 210,022

[22] Filed: Mar. 18, 1994

[51] Int. Cl.[5] ..... B42D 15/00

[52] U.S. Cl. ..... 283/65; 283/903

[58] Field of Search ..... 283/65, 45, 901, 903; 40/491, 489, 490

[56] References Cited

U.S. PATENT DOCUMENTS 4,233,768 11/1980 Bromberg ..... 283/65 X
4,431,214 2/1984 Buffington ..... 283/65
4,580,814 4/1986 Berler ..... 283/65 X
4,786,083 11/1988 King ..... 283/65 X

*Primary Examiner*—Willmon Fridie
*Attorney, Agent, or Firm*—Thomas W. Tolpin

[57] ABSTRACT

An efficient hand-held scanner simultaneously isolates and blocks out all but a single row of numbers on a lottery ticket at a time for ready comparison with winning lottery number displayed on the scanner. The multipurpose scanner has windows and displays for accommodating a six number weekly lottery game and a five number daily lotto game. The convenient scanner also has a support member, which preferably comprises an inclined flap, to support and guide lottery tickets past the windows of the scanner.

5 Claims, 3 Drawing Sheets

10
86
80
96
18
14
64
26
DRAWING DATE
48
6 WINNING NUMBERS
41
42
43
44
45
46
35
30
DRAWING DATE
56
5 WINNING NUMBERS
51
52
53
54
55
37
34
32
36
92
22
100
38
60
62
24
20
16

10
18
14
64
26
DRAWING DATE
48
6 WINNING NUMBERS
41
42
43
44
45
46
30
35
34
DRAWING DATE
56
5 WINNING NUMBERS
51
52
53
54
55
32
37
36
38
22
60
62
92
100
24
20
16

SCANNER

BACKGROUND OF THE INVENTION

This invention pertains to image readers and, more particularly, to a scanner for scanning lottery tickets.

Lottery games are a very attractive way for state and local governments in the United States, Canada and elsewhere to raise public funds for education, public programs and various projects. Lottery games are very popular among consumers and taxpayers. Some states have weekly or biweekly lottery games in which a customer selects a series of six numbers ranging from 1 to 60, for a state regulated price, such as fifty cents. The selected numbers appear in a row on a lottery ticket. Customers often purchase more than one series of six numbers. Lottery tickets can include 10 or more rows of lottery numbers with each row containing a different series of selected numbers.

Some states also have daily or weekly lotto (lottery) games in which a customer picks a set of five numbers for a state regulated price. The selected numbers appear in a row on a daily lottery ticket. Daily and weekly lotto customers often purchase more than one set of five numbers. Daily and weekly lottery tickets can also contain multiple rows of lottery numbers.

A grand prize is awarded to or split among customers who correctly select all lottery numbers for a given lottery drawing. A second place prize is awarded or divided among customers who correctly pick all but one lottery number for a particular lottery drawing. A lesser third prize is often awarded to customers who correctly get all but two lottery numbers for a lottery drawing on a selected date.

Many lottery customers purchase numerous lottery tickets. It is not uncommon for customers to puchase 10 to 40 tickets especially when the grand lotto prize is millions of dollars. Some customers or pools of customers purchase hundreds of lottery tickets.

It is difficult, cumbersome, awkward, tedious, confusing and very time-consuming to compare the winning lottery numbers appearing in local newspapers with rows of numbers on lottery tickets. Consumers often get stiff necks, bloodshot eyes and eyestrain, checking lottery numbers in this manner. Furthermore, many customers get tired and easily confused with using this conventional technique to check lottery ticket numbers and often miss detecting a winning sequence of lottery numbers appearing on the tickets they purchased. In other words, many ticket holders are unaware that they possess a winning lottery ticket. As a result, many customers fail to collect the grand prize, second prize, or third prize that they are entitled to.

It is, therefore, desirable to provide an affordable, convenient scanner for consumers which overcomes most, if not all, of the preceding problems.

SUMMARY OF THE INVENTION

An improved scanner is provided which is especially useful to identify and detect winning numbers on a lottery ticket. Advantageously, the improved scanner is light weight, portable, easy-to-use and reliable. Desirably, the user friendly scanner is biodegradable, compact and economical. It is also efficient, effective and attractive.

The novel scanner can have at least one numeric portion to display numbers, such as the winning numbers of a lottery drawing. The novel scanner can also have at least one window positioned in proximity to the numeric display portion, to view and focus on a row or sequence of numbers on a stem, such as a lottery ticket and mask other numbers on the item to minimize confusion. Preferably, the numeric display portion has 5 to 6 viewable sections of a size and shape so that each section can display a number ranging from 1 to 99. The viewable sections can comprise annular displays.

The novel scanner can have a tab secured to the web or a flap integrally connected to the web. The flap can be slanted or inclined at an angle ranging from 5 to 90 degrees. The web and flap can be laminated or covered with a protective coating of transparent plastic to form a liquid-impervious layer or barrier so that the scanner can be wiped clean for reuse. If desired, the scanner can be made of plastic, metal, wood, paperboard, cardboard, cardstock, or glass.

In the preferred form, the scanner comprises a multi-lottery game scanner with an enlarged transverse opening providing a first window, such as for viewing a series of six lottery numbers in a weekly or biweekly lotto game, and has a smaller transverse opening providing a second window, such as for viewing a series of five lottery numbers in a daily lotto game.

Desirably, the scanner is constructed and arranged to isolate and display a single row of numbers on the lottery ticket at a time. This significantly avoids the errors, oversights and ambiguity caused by conventional multiple row reading and viewing. To this end, each window is aligned and sized to block out all but a single row of lottery ticket numbers. Such an arrangement helps the user efficiently view, clearly read, rapidly scan, and readily compare lottery ticket numbers with the winning numbers displayed on the numeric portion of the scanner.

Preferably, the panel has an enlarged numeric display positioned adjacent the first window to display a first set of numbers, such as the six winning lottery numbers in a weekly or biweekly lottery game, and has a smaller numeric display positioned adjacent the second window to display a second set of numbers, such as the five winning lottery numbers of a daily lotto game. The numeric display can comprise laterally aligned numeric display portions. Preferably, the numeric displays comprise annular displays simulating lotto balls.

In the preferred form, the scanner has a member, to support an item to be viewed through the windows, such as a lottery ticket. The support member can extend integrally and rearwardly or downwardly from the panel. Preferably, the support member comprises an inclined flap or biased tab which cooperates with the back of the panel to provide a v-shaped guide pocket to guide the lottery ticket past the windows.

While the above described scanner is preferred for simplicity, cost effectiveness, and ease of manufacture and use, in some circumstances it may be desirable that the scanner be arranged to peripherally surround, annularly enclose, or envelope all or part of the lottery ticket and/or that the support member of the scanner support the entire width of the lottery ticket. Such a scanner can comprise an open ended scanner having an annular configuration with an elliptical, concave or rectangular cross-section. The support member or flap can comprise a lottery ticket-supporting back panel or rearward panel which is symmetrical and similar in size to the front panel.

A more detailed explanation of the invention is provided in the following description and claims.

DETAILED DESCRIPTION OF THE PREFERRED EMBODIMENTS

Figure 8:
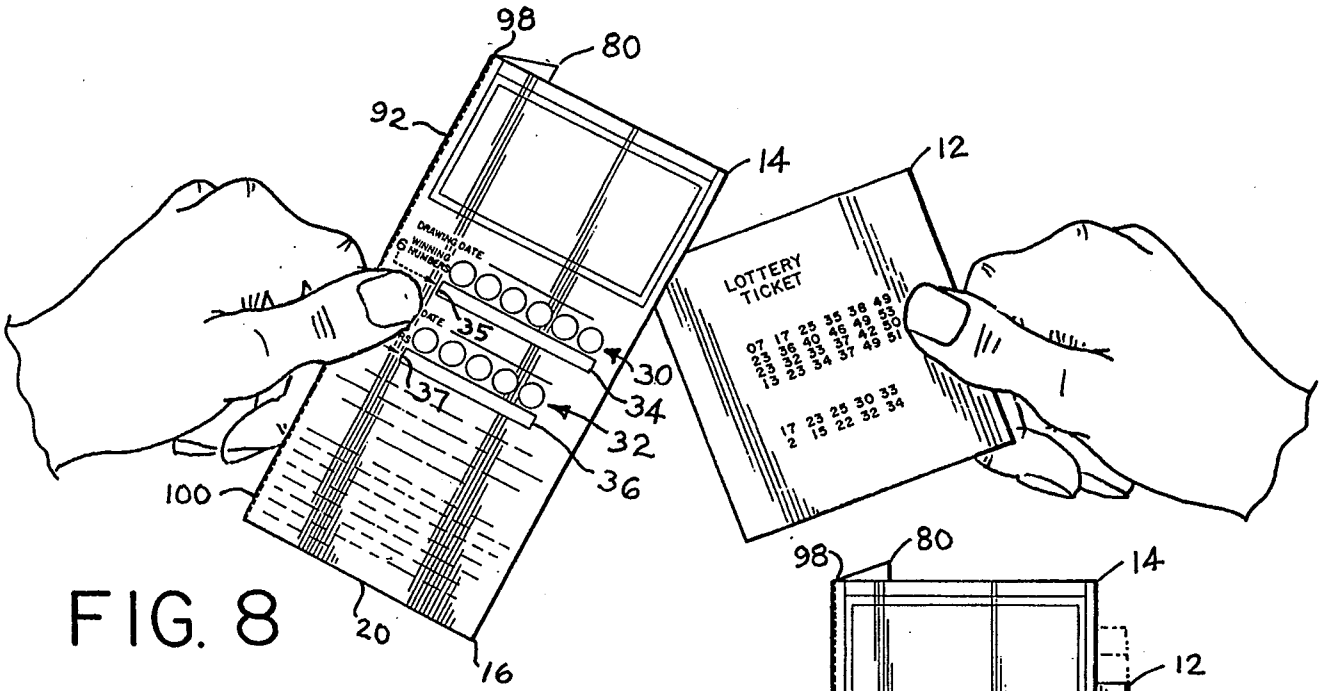
FIG. 8 is a graphic illustration of a lottery ticket being placed behind the scanner in preparation for scanning.
Figure 9:
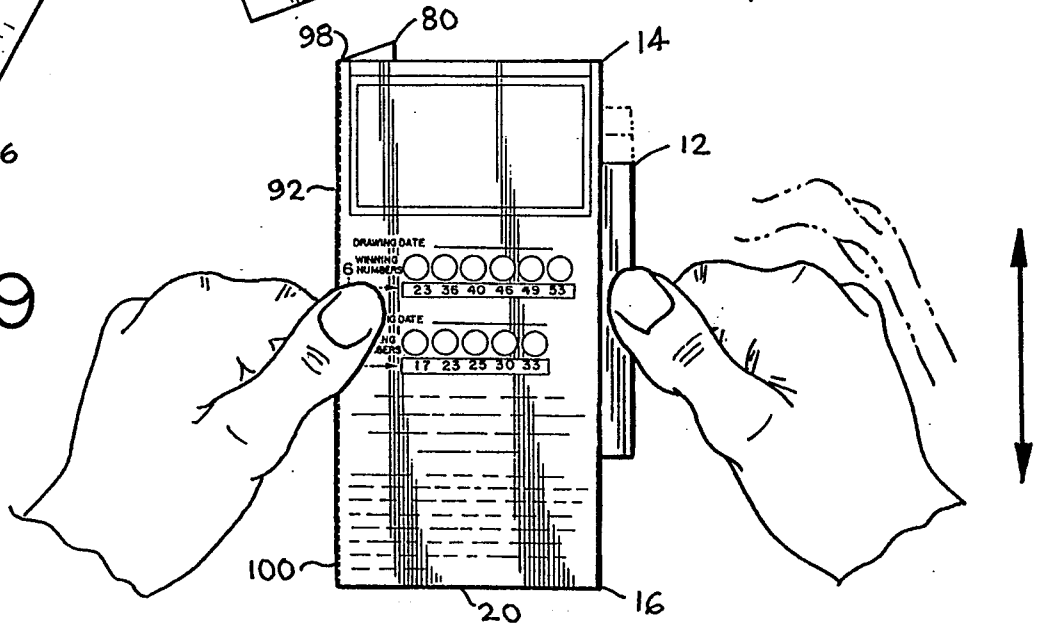
FIG. 9 is a graphic illustration showing operation of the lottery ticket scanner in which the lottery ticket is slid up and down behing the scanner to view the lottery ticket numbers through the scanner's windows.

A lottery ticket scanner 10 provides a visual enhancement, lottery guide, framing tool, comparison view card, comparitor and visual scanner to readily scan, detect, sense, read and identify winning numbers on a lottery ticket 12 (FIGS. 8 and 9). Desirably, the lottery ticket scanner 10 blocks out all but one row of lottery numbers on a lottery ticket during any moment of scanning so that the viewer can focus and concentrate on one row of lottery numbers at a time for comparison with the wining numbers of a lottery game. Advantageously, the scanner 10 is convenient, comfortable and simple to assemble and operate. The scanner 10 is also lightweight, portable and can be held in the user's hand.

The lottery ticket scanner 10 (FIGS. 1–7) has a flat or planar elongated web 14 comprising a rectangular panel 16 with parallel ends 18 and 20, elongated parallel sides 22 and 24, a front 26 and a back 28. The ends of the panel include a horizontal upper top edge 18 and a horizontal lower bottom edge 20. The elongated sides of the panel 16 include a free unattached vertical outside (outer) edge 22 and an attached vertical inside (inner) hinged edge 24. The front 26 of the panel 16 has a primary display area 30, a secondary display area 32, a primary viewing area 34, a secondary viewing area 36, and at least one front information area 38. The back 28 (FIG. 5) of the panel 16 has at least one back information area 40.

The primary display area 30 (FIGS. 1 and 2) of the panel 16 comprises six primary annular or circular displays 41–46 which simulate lottery balls. The primary circular displays 41–46 are the same size and are horizontally aligned in registration with each other. The primary circular displays 41–46 provide a primary recording section for recording and displaying six winning numbers of a lottery drawing, such as from a weekly lottery game. Preferably, each of the primary displays 41–46 are of a sufficient size to accommodate only two digits. The primary display area 30 of the panel 16 also has a primary date zone or area 48 positioned above the primary circular displays 41–46 to record and display a date of the lottery drawing for the six winning numbers.

The primary viewing area 34 is positioned between the primary and secondary display areas 30 and 32. The primary viewing area 34 comprises a top rectangular primary window 35 for viewing a row of six numbers on a lottery ticket. The primary window 35 can comprises a cutout that extends through the front 26 and back 28 of the panel 16. The primary window 35 is elongated in the horizontal or lateral direction. Preferably, the top primary window 35 is of a size to permit viewing of only one row of six numbers on the lottery ticket. Accordingly, the top primary window 35 spans a horizontal width slightly greater than the six numbers on the lottery ticket and has a height greater than the height of the six numbers on the lottery ticket. Preferably, the top primary window 35 also spans a horizontal width slightly greater than the maximum horizontal span of the primary circular displays 41–46 for ease of comparing a row of six lottery ticket numbers with the six winning numbers displayed in the balls comprising the circular displays 41–46.

The secondary display area 32 of the panel 16 is positioned between the primary and secondary viewing areas 34 and 36. The secondary display area 32 comprises five secondary annular or circular displays 51–55 which simulate lottery balls. The secondary circular displays 51–55 are the same size and are horizontally aligned in registration with each other. The secondary circular displays 51–55 provide a secondary recording section for recording and displaying five winning numbers of a lottery drawing, such as in a daily lotto game. Preferably, each of the secondary displays 51–55 are of a sufficient size to accommodate only two digits. The secondary display area 32 of the panel 16 also has a secondary date zone or area 56 that is positioned between the secondary circular displays 51–55 and the primary window 35 to record and display the date of the lottery drawing for the five winning numbers.

In the illustrative embodiment, the balls providing the top and bottom circular displays 41–46 and 51–52, are the same size. Desirably, the winning numbers recorded and displayed in the balls (circular displays) of the panel 16 are vertically aligned with the lottery ticket numbers appearing in the windows 35 and 37.

The secondary viewing area 36 is positioned below the secondary circular displays 51–55 of the secondary display area 32. Preferably, the secondary viewing area 36 comprises a bottom rectangular secondary window 37 to view a row of five numbers on a lottery ticket. The secondary window 37 can be a cutout that extends through the front 26 and back 28 of the panel 16. Desirably, the secondary window 37 is of a size for permitting viewing of only one row of five numbers on the lottery ticket at a time. To this end, the bottom secondary window spans a horizontal width slightly greater than five numbers on the lottery ticket and has a height greater than the height of the five numbers on the lottery ticket. Preferably, the bottom secondary window 37 also spans a horizontal width slightly greater than the maximum horizontal span of the secondary circular displays 51–55 for ease of comparing a row of five lottery ticket numbers with the five winning numbers displayed in the balls comprising the circular displays 51–55. The bottom secondary window 37 is preferably elongated in the horizontal or lateral direction. While the above arrangement is preferred for ease of manufacture and economy, it may be desirable in some circumstance that the top and/or bottom windows be oblong or comprise transparent plastic or glass.

The front information area 38 of the panel 16 comprises a lower front information zone or area 60 that is positioned below the bottom secondary window 37. The front information area 60 contains indicia 62 providing instructions and information about use of the lottery guide scanner 10. The front information area can also include an upper front information zone 64 that is positioned above the top primary date zone 48.

The back information area 40 (FIG. 5) on the backside 28 (back) of the panel 16 includes a lower back information zone 66 which is positioned below the bottom secondary window 37. The lower back information zone 66 is located generally opposite the lower front information zone 60 on the front 26 of the panel 16. The back information area 40 on the backside 28 (back) of the panel 16 can also includes an upper back information zone 68 which is positioned above the top primary window 35. The upper back information zone 64 is located generally opposite the upper front information zone 64 on the front 26 of the panel 16. The lower back information zone 66 can be imprinted with indicia 70 graphically depicting use of the lottery guide scanner 10. The upper back information zone 68 can be imprinted with indicia 72 providing tax information or marketing or advertising material.

Figure 1:
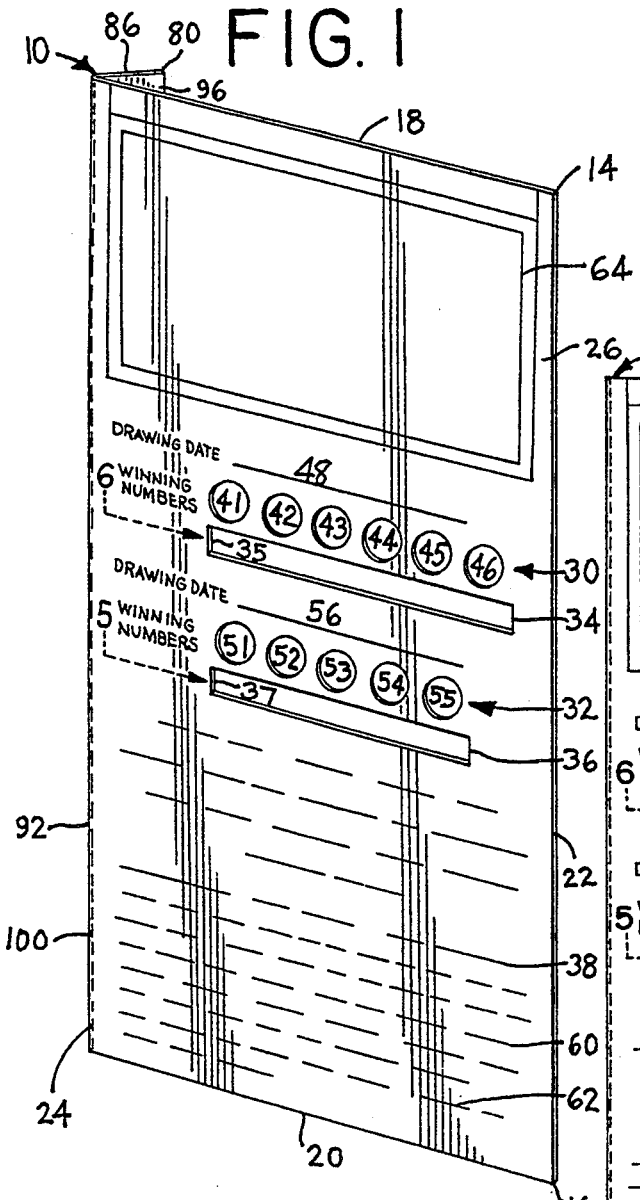
FIG. 1 is a perspective view of the lottery ticket scanner in accordance with principles of the present invention.
Figure 2:
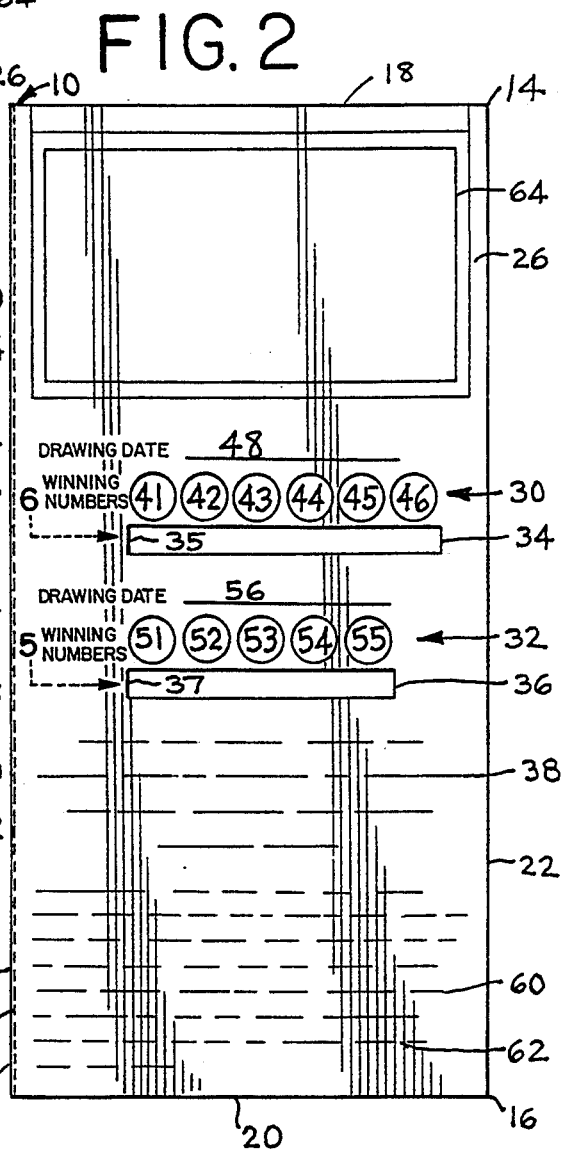
FIG. 2 is a front view of the lottery ticket scanner.
Figure 3:
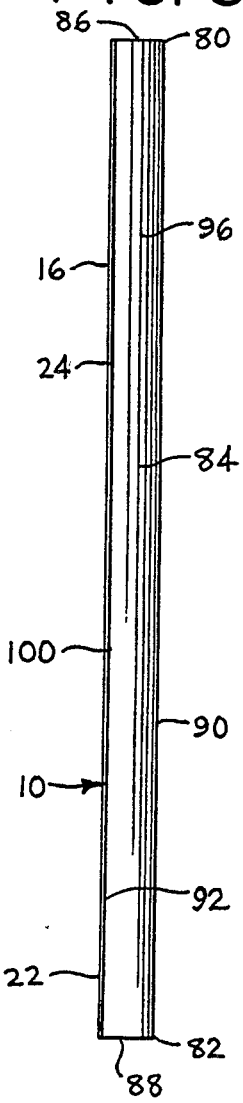
FIG. 3 is a right side view of the lottery ticket scanner.
Figure 4:
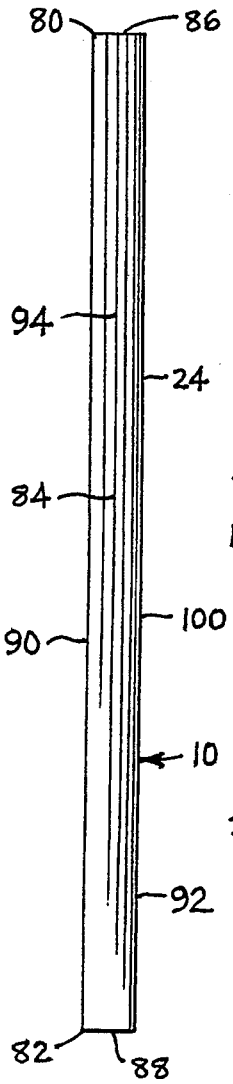
FIG. 4 is a left side view of the lottery ticket scanner.
Figure 5:
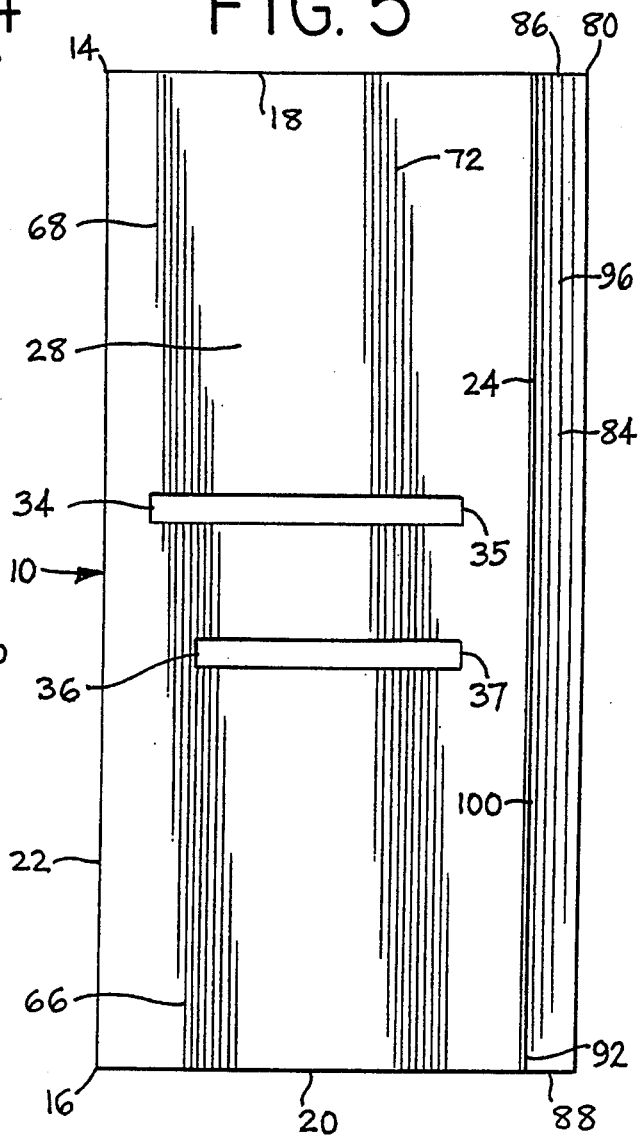
FIG. 5 is a back view of the lottery ticket scanner.

The lottery ticket scanner 10 (FIGS. 1–7) also has a flat or planar elongated flap 80 which is hingeably connected (hinged) to and cantilevered from the panel 16. As best shown in FIGS. 4 and 9, the flap 80 comprises a rectangular upright resilient guide member 82 which provides an elongated tab 84 to guide the lottery ticket 12 along the back 28 of the panel 16. The flap 80 (FIGS. 3–5) has: parallel end portions 86 and 88, elongated parallel side portions 90 and 92, a front surface 94, and a back surface 96 providing an underside. The end portions of the flap 80 include a horizontal top upper edge 86 that is positioned in coplanar alignment with the upper edge 18 of the panel 16. The end portions of the flap 80 also include a horizontal lower bottom edge 88 that is positioned in coplanar alignment with the lower edge 20 of the panel 16. The elongated side portions of the flap include a free unattached upright outside (outer) flap edge 90. The elongated side portions of the flap also include an upright inside (inner) hinge portion 92 that is pivotally attached to the inside edge 24 of the panel 16.

Figure 6:
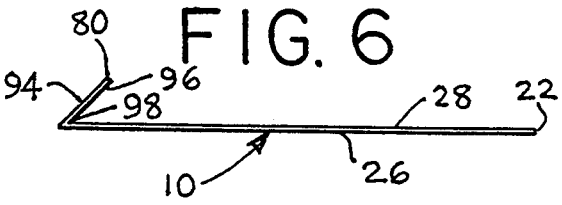
FIG. 6 is a top view of the lottery ticket scanner.
Figure 7:
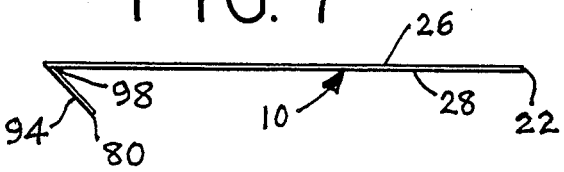
FIG. 7 is a bottom view of the lottery ticket scanner.

The flap 80 is moveable from an unfolded flat storage position in which the flap 80 is disposed in coplanar alignment with the panel 16, to a compressed bent position when then the flap 80 is folded, compressed, clamped, or pinched. In the bent position, the back surface 96 of the flap 80 compressively engages, contact and touches the back 28 of the panel 16. Preferably, the flap 80 is normally biased to a slanted or cradling position (angled position) that is disposed downwardly and inwardly at an angle of inclination ranging from 30 degrees to 60 degrees and most preferably 45 degrees as shown in FIGS. 6 and 7. Desirably, the back 96 of the biased flap 80 cooperates with the back of the panel 16 to form a pocket 98 (FIGS. 8 and 9) to slidably support, guide and cradle a lottery ticket so that the numbers on the lottery ticket can be read, viewed and scanned through the windows 35 and 37 of the panel 16 in order to slidably detect whether the lottery ticket numbers correspond to the winning numbers in the display areas 30 and 32 of the panel 16.

Preferably, the back surface 96 of the flap 80 is scored so as to provide a scoreline 100 along the hinged portions 24 and 92. Scoring in this manner enhances the resiliency of the flap 80 and helps prevent cracking of colored indicia 62 and 64 in the front information area 38 on the front 26 of the panel. In the illustrated embodiment, the flap 80 spans a maximum horizontal distance less than the minimum distance between the scoreline 100 and the windows 35 and 37.

The lottery ticket scanner 10 is preferably fabricated of 10 point cardstock for ease of use. In some circumstances, it may be desirable that the scanner 10 be fabricated of different point cardstock, or cardstock of a different thickness and texture, or other materials.

Lottery ticket scanners can be packaged in transparent plastic, e.g. four scanners shrink-wrapped in a cellophane wrapper, and displayed in a slotted rack. Such an arrangement provides an attractive display on a counter where lottery tickets are sold.

It can be seen that the lottery ticket scanner can be used to scan lottery tickets with several rows of numbers to accurately and easily compare lottery ticket numbers with winning numbers drawn in a lottery game. In order to use the lottery ticket scanner, the customer (user) enters the date and winning numbers in a display area. If the lottery game has six winning numbers, the winning numbers and date of the lottery drawing are recorded and displayed in the upper display area 30. If the lottery game has five winning numbers, the winning numbers and date of the lottery drawing are recorded and displayed in the lower display area 32. The flap 80 on the left side of the panel should then be unfolded and moved to its inclined position to provide a guide pocket 98 (FIGS. 8 and 9) for slidably receiving the lottery ticket. The lottery ticket should then be placed behind the panel as shown in FIG. 8 until it fits comfortable in the guide pocket. The lottery ticket should then be slid or otherwise moved up or down until a row of lottery ticket numbers shows through a window 35 or 37 as shown in FIG. 9. The customer can then readily compare the lottery numbers in the window with the winning numbers in the circular displays (lotto balls) 41–46 or 51–55 aligned above the windows 35 and 37. The lottery ticket is sequentially, progressively and rapidly moved (slid) until each row of lottery ticket numbers has appeared in the windows 35 and 37 and compared with the winning numbers. After the customer has scanned all the customer's lottery tickets for a particular drawing, the non-winning lottery tickets can be kept, held, clamped and stored by the flap 80 and panel 16 of the scanner, if desired, for tax records.

Among the many advantages of the lottery ticket scanner of the invention are:

1. Improved capability and method to read and compare lottery ticket numbers with winning numbers.
2. Superior sequential identification, isolation and masking of rows of numbers.
3. Energy savings through the use of non-electrical scanning.
4. Outstanding performance.
5. Saves substantial time for the user.
6. Excellent scanning.
7. Compact.
8. Biodegradable.
9. Fine quality.
10. Easy to operate.
11. Superb.
12. Compact.
13. Portable.
14. Attractive.
15. Economical.
16. Dependable.

17. Efficient.
18. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. A scanner, comprising:

a substantially planar elongated web comprising a substantially rectangular panel with substantially parallel ends, elongated substantially parallel sides, a front and a back, said ends comprising a substantially horizontal upper edge and a substantially horizontal lower edge, said elongated sides comprising a free unattached substantially vertical outside edge and an attached substantially vertical inside edge, said front having a primary display area, a secondary display area, a primary viewing area, a secondary viewing area, and at least one front information area, and said back having at least one back information area;

said primary display area comprising six primary substantially circular displays, said primary circular displays being substantially the same size and aligned in substantial horizontal registration with each other, said primary circular displays providing a primary recording section for recording and displaying six winning numbers of a lottery drawing, each of said primary displays being of a sufficient size to accommodate two digits, and said primary display area having a primary date zone for recording and displaying a date of the lottery drawing for the six winning numbers;

said primary viewing area being positioned between said primary and secondary display areas, said primary viewing area comprising a substantially rectangular primary window for viewing a row of six numbers on a lottery ticket, said primary window extending through said front and back and spanning a horizontal width slightly greater than the six numbers on the lottery ticket, said primary window spanning a horizontal width slightly greater than the maximum horizontal span of said primary display and having a height greater than the height of the six numbers on the lottery ticket, and said primary window being of a size for permitting viewing of only one row of six numbers on the lottery ticket;

said secondary display area being positioned between said primary and secondary viewing areas, said secondary display area comprising five secondary substantially circular displays, said secondary circular displays being substantially the same size and aligned in substantial horizontal registration with each other, said secondary circular displays providing a secondary recording section for recording and displaying five winning numbers of a lottery drawing, each of said secondary displays being of a sufficient size to accommodate two digits, and said secondary display area having a secondary date zone positioned between said secondary circular displays and said primary window for recording and displaying the date of the lottery drawing for the five winning numbers;

said secondary viewing area being positioned below said secondary circular displays of said secondary display area, said secondary viewing area comprising a substantially rectangular secondary window for viewing a row of five numbers on a lottery ticket, said secondary window extending through said front and back and spanning a horizontal width slightly greater than five numbers on the lottery ticket, said secondary window spanning a horizontal width slightly greater than the maximum horizontal span of said secondary displays and having a height greater than the height of the five numbers on the lottery ticket, and said secondary window being of a size for permitting viewing of only one row of five numbers on the lottery ticket;

said front information area comprising a lower front information zone positioned below said secondary window, and said front information area containing indicia providing instructions and information about use of the lottery guide scanner;

said back information area comprising a lower back information zone positioned below said secondary window and located opposite said lower front information zone, said lower back information zone being imprinted with indicia graphically depicting use of the lottery guide scanner; and a substantially planar elongated flap hingeably connected to and cantilevered from said panel, said flap comprising a substantially rectangular resilient guide member for guiding the lottery ticket, said flap having substantially parallel end portions, elongated substantially parallel side portions, a front surface, and a back surface providing an underside, said end portions comprising a substantially horizontal top edge positioned in coplanar alignment with the upper edge of the panel and a substantially horizontal bottom edge positioned in coplanar alignment with the lower edge of the panel, said elongated side portions comprising a free unattached upright outside flap edge and an upright inside hinge portion pivotally attached to said inside edge of said panel, said flap being moveable from an unfolded storage position disposed in coplanar alignment with said panel, to a compressed bent position for compressively engaging said panel with said back surface contacting said back of said panel, and said flap being normally biased to a cradling position disposed downwardly and inwardly at an angle of inclination ranging from about 30 degrees to about 60 degrees and cooperating with the back of the panel to provide a pocket for slidably supporting, guiding and cradling a lottery ticket so that the numbers on the lottery ticket can be scanned through the windows of said panel in order to slidably detect whether the lottery ticket numbers correspond to the winning numbers in the display area of the panel.

2. A scanner in accordance with claim 1 wherein:

said panel and said flap comprise 10 point cardstock;

said biased flap is urged to about a 45 degree angle of inclination; and said front information area further includes an upper front information zone positioned above said primary date zone.

3. A scanner in accordance with claim 1 wherein said back surface has a scoreline along said hinged portion for enhancing the reliliency of said flap and for substantially preventing cracking of colored indicia in said front information area.

4. A scanner in accordance with claim 1 wherein said primary circular displays are of a substantially similar size to said secondary circular displays, and the winning numbers displayed in said circular displays are substantially aligned with the numbers appearing in the windows of the panel.

5. A scanner in accordance with claim 4 wherein said flap spans a maximum horizontal distance less than the minimum distance between said scoreline and said windows.

* * * * *